US007345637B2

(12) United States Patent
Mizoguchi et al.

(10) Patent No.: US 7,345,637 B2
(45) Date of Patent: Mar. 18, 2008

(54) RADIO DEVICE AND ELECTRONIC APPARATUS

(75) Inventors: Satoshi Mizoguchi, Tokyo (JP); Takashi Amano, Saitama (JP); Koichi Sato, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 51 days.

(21) Appl. No.: 11/475,398

(22) Filed: Jun. 26, 2006

(65) Prior Publication Data

US 2007/0115188 A1 May 24, 2007

(30) Foreign Application Priority Data

Nov. 18, 2005 (JP) ..... 2005-335003

(51) Int. Cl.

| | |
|---|---|
| ***H01Q 1/24*** | (2006.01) |
| ***H01Q 1/38*** | (2006.01) |
| ***H01Q 5/00*** | (2006.01) |
| ***H01Q 9/04*** | (2006.01) |

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 7,136,022 B2 * 11/2006 Sato et al. ..... 343/702

OTHER PUBLICATIONS

Ohom Sha Ltd., "Antenna Engineering Handbook," The Institute of Electronics, Info. and Comm. Engrs. Japan, Oct. 1996, pp. 112-113 and Figs. 4-1 and 4-3.

Satoh and Amano: "Two-Points Short-Circuited Folded Antenna Sharing Two Frequencies," The 2004 IEICE General Conference B-1-57, Mar. 2004.

* cited by examiner

*Primary Examiner*—Hoang V. Nguyen
*Assistant Examiner*—Robert Karacsony
(74) *Attorney, Agent, or Firm*—Blakely, Sokoloff Taylor & Zafman

(57) ABSTRACT

The invention provides a radio device in which multi-resonance promotion and impedance adjustment can be readily performed and a restriction in a mounting space can be dissolved, and an electronic apparatus having the same installed therein. Provision of a stub (123) having a large area and serving as a frequency matching portion as well in a folded monopole antenna (120) results in that a conductor area can be increased, and a resonance frequency can be shifted to lower frequencies. In addition, a frequency of a radio communication antenna can be readily adjusted because the resonance frequency is adjusted by cutting the stub (123).

13 Claims, 12 Drawing Sheets

RADIO DEVICE AND ELECTRONIC APPARATUS

The present application is based on Japanese patent application No. 2005-335003, the entire contents of which are incorporated herein by reference.

BACKGROUND

1. Field

One embodiment of the invention relates to a radio device and an electronic apparatus having the same installed therein, and more particularly to a radio device having multi-resonance type antennas, and an electronic apparatus having the same installed therein.

2. Description of the Related Art

In recent years, various terminals having respective radio devices installed therein have come into wide use. Radio communication antennas installed in these terminals, respectively, are proceeding from whip type antennas which have been widely adopted to built-in antennas. Use of the built-in antenna offers such advantages that the built-in antenna is more readily handled in use and accommodation than the whip type antenna is handled, and the degree of freedom for a chassis design increases, and so forth. In particular, the advantage of being able to further thin the chassis is great.

In the conventional built-in antenna, when the miniaturization of the chassis progresses, so that the built-in antenna is disposed closer to a substrate, an impedance decreases because an antenna element is disposed close to a metallic portion of a peripheral circuit or the like. As a result, impedance mismatching is generated between the antenna and a power supply circuit to cause reduction of performance in some cases.

A folded dipole antenna is known as a technique with which an impedance of an antenna is suitably set so as not to decrease too much. The folded dipole antenna is an antenna in which two or more dipole antennas are disposed in close proximity in parallel to each other, their heads are connected to each other, and one of these dipole antennas is supplied with a power at a central feeding point. This technique is disclosed in a first literature of "Antenna Engineering Handbook", edited by THE INSTITUTE OF ELECTRONICS, INFORMATION AND COMMUNICATION ENGINEERINGS, Ohom sha Ltd., Japan, October, 1996 (refer to pp. 112 and 113, and FIGS. 4•1 and 4•3). Normally, the dipole antennas are disposed on both sides of the feeding point so as to be symmetrical with respect to the feeding point.

The folded dipole antenna has such a feature that an impedance can be made larger than that of a normal unfolded dipole antenna, and a value of the impedance can be adjusted in accordance with a ratio in line diameter of parallel lines. However, the dipole antenna is unsuitable for an antenna built in a compact apparatus since it is essentially easy to increase in shape, and thus the dipole antenna is folded in more complicated shape.

In addition, the broadening of the band for the antenna is required in accordance with diversification of communication systems and applications of radio devices. In order to comply with this requirement, an antenna needs to be constructed by combining a plurality of antenna elements having different resonance frequencies with one another. The dipole antenna is also disadvantageous in that the antenna elements become largely complicated.

The folded dipole antenna can also be used as a monopole antenna. In this case, one end of one of the antenna elements which are symmetrically constructed in the folded dipole antenna is supplied with a power and the other end of the one thereof is grounded. This monopole antenna is called a folded monopole antenna. The folded monopole antenna has theoretically the characteristics equal to those of the folded dipole antenna, and may adopt a construction which is half in scale that of the folded dipole antenna. Thus, the practical application of the folded monopole antenna to a compact apparatus is examined now. Such a practical application of the folded monopole antenna is disclosed in a second literature of Satoh and Amano: "Two-points short-circuited folded antenna sharing two frequencies", THE 2004 IEICE GENERAL CONFERENCE B-1-57, MARCH, 2004.

The technique disclosed in the second literature is such that the so-called inverse L type folded monopole antennas each having a relatively low position are combined with each other, and the respective resonance frequencies are made different from each other, thereby realizing multi-resonance promotion.

The prior art disclosed in the second literature has such a feature that it is suitable for thinning the radio device by using the antenna elements each having the relatively low position, and one-side antenna element is short-circuited halfway, thereby obtaining easiness of the impedance adjustment of an opposite-side antenna element in addition to the multi-resonance promotion. However, since it is necessary to combine a plurality of folded antenna elements with each other, there is still room for improvements in order to cope with a restriction in a mounting space accompanying more multi-function promotion for a compact radio device.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION OF PREFERRED EMBODIMENTS

Figure 1A:
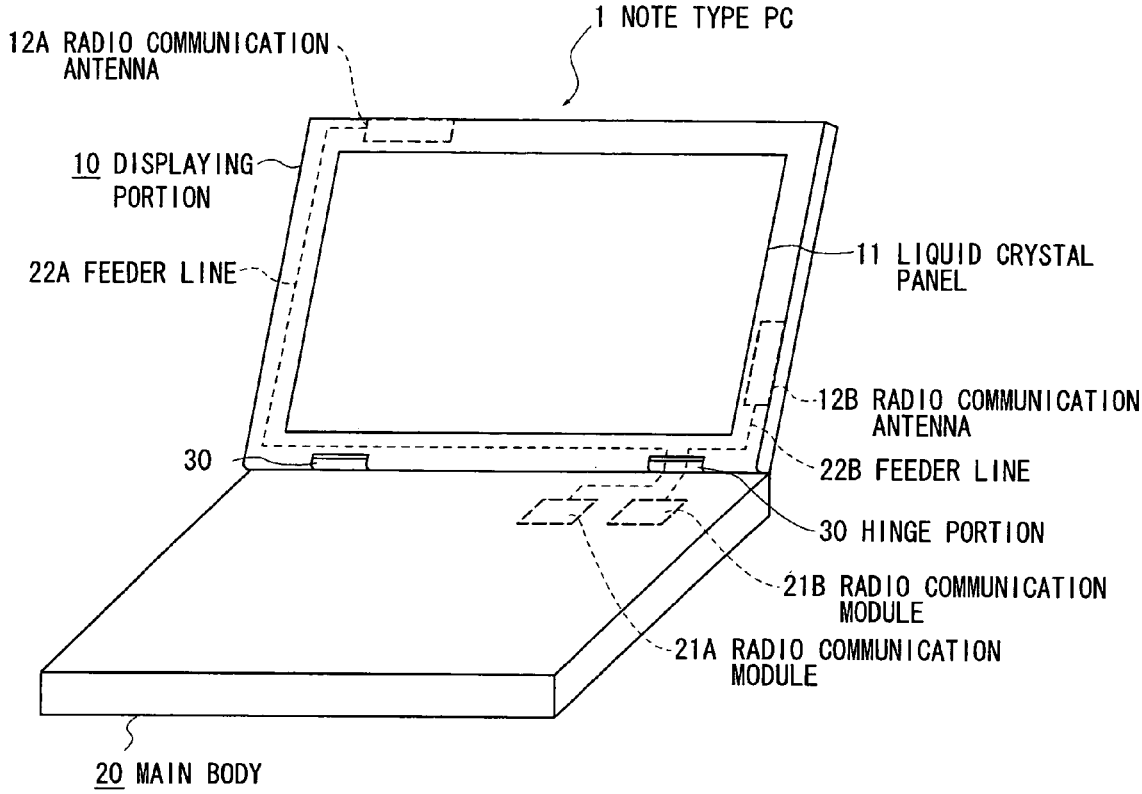
FIGS. 1A and 1B are respectively an exemplary perspective view showing a note type personal computer as an electronic apparatus according to a first embodiment of the present invention, and an exemplary plan view showing a radio communication antenna accommodated in an envelope case of a displaying portion of the note type personal computer shown in FIG. 1A.

Various embodiments according to the invention will be described hereinafter with reference to the accompanying drawings. In general, according to one embodiment of the invention, there is provided a radio device, including: a power supply circuit for generating a high-frequency signal corresponding to a transmission signal to be transmitted in a radio manner; a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion; and a second antenna branching, from the first antenna, in a branch portion located between the feeding point in the outward path and the short-circuit portion, having a released head and having a portion from the feeding point in the outward path to the branch portion in common with the first antenna, a length from the feeding point to the head through the branch portion corresponding to a quarter of a wavelength of the second frequency belonging to the use frequency band, in which the folded path of the first antenna has a length corresponding to a half of the wavelength of the second frequency, or a value close thereto.

In addition, according to one embodiment of the invention, there is provided a radio device, including: a power supply circuit for generating a high-frequency signal corresponding to a transmission signal to be transmitted in a radio manner; a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion; a second antenna branching, from the first antenna, in a branch portion located between the feeding point in the outward path and the short-circuit portion, having a released head and having a portion from the feeding point in the outward path to the branch portion in common with the first antenna, a length from the feeding point to the head through the branch portion corresponding to a quarter of a wavelength of the second frequency belonging to the use frequency band; and a parasitic element connected to the grounding point, in which the folded path of the first antenna has a length corresponding to a half of the wavelength of the second frequency, or a value close thereto.

In addition, according to one embodiment of the invention, there is provided an electronic apparatus, including: a radio communication portion; and an enclosure case for accommodating therein the radio communication portion, the radio communication portion, including: a power supply circuit for generating a high-frequency signal corresponding to a transmission signal to be transmitted in a radio manner; a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion; and a second antenna branching, from the first antenna, in a branch portion located between the feeding point in the outward path and the short-circuit portion, having a released head and having a portion from the feeding point in the outward path to the branch portion in common with the first antenna, a length from the feeding point to the head through the branch portion corresponding to a quarter of a wavelength of the second frequency belonging to the use frequency band, in which the folded path of the first antenna has a length corresponding to a half of the wavelength of the second frequency, or a value close thereto.

Also, according to one embodiment of the invention, there is provided an electronic apparatus, including: a radio communication portion; and an enclosure case for accommodating therein the radio communication portion, the radio communication portion, including: a power supply circuit for generating a high-frequency signal corresponding to a transmission signal to be transmitted in a radio manner; a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion; a second antenna branching, from the first antenna, in a branch portion located between the feeding point in the outward path and the short-circuit portion, having a released head and having a portion from the feeding point in the outward path to the branch portion in common with the first antenna, a length from the feeding point to the head through the branch portion corresponding to a quarter of a wavelength of the second frequency belonging to the use frequency band; and a parasitic element connected to the grounding point, in which the folded path of the first antenna has a length corresponding to a half of the wavelength of the second frequency, or a value close thereto.

According to the present invention, the multi-resonance promotion and the impedance matching can be readily performed, and the restriction in the mounting space can be dissolved.

First Embodiment

Figure 1B:
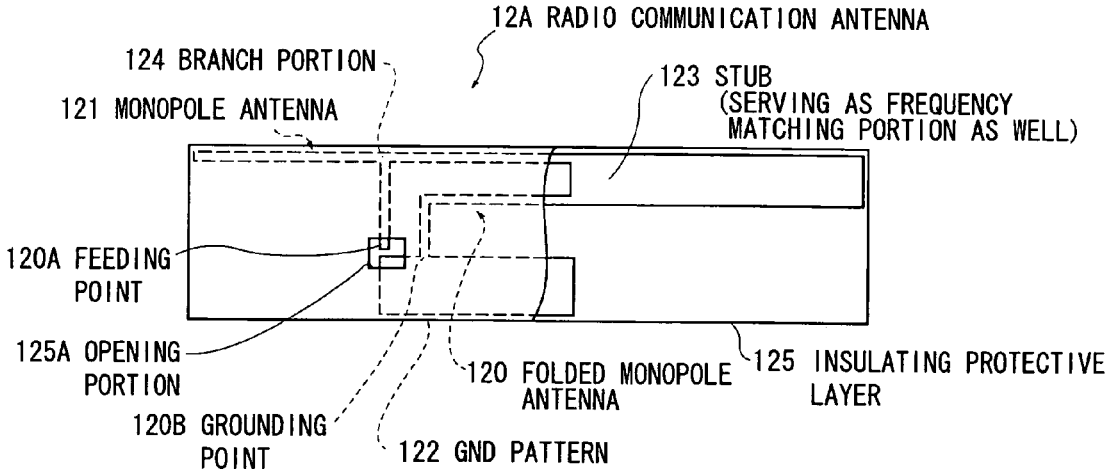

FIGS. 1A and 1B are respectively a perspective view showing a note type personal computer (PC) as an electronic apparatus according to a first embodiment of the present invention, and a plan view showing a radio communication antenna accommodated in an envelope case of a displaying portion of the note type PC shown in FIG. 1A

Construction of Note Type PC 1

A note type PC 1, as shown in FIG. 1A, is constituted by a displaying portion 10 and a main body 20 when being roughly classified. In the first embodiment, the displaying portion 10 is a liquid crystal display device having a liquid crystal panel 11, and has radio communication antennas 12A and 12B in an upper portion and a side portion of the liquid crystal panel 11, respectively. In addition, the display portion 10 and the main body 20 are openably and closeably constructed.

The main body 20 has radio communication modules 21A and 21B as power supply circuits each of which serves to generate a high-frequency signal corresponding to a transmission signal in order to transmit/receive a radio wave. The radio communication modules 21A and 21B are connected to the radio communication antennas 12A and 12B through feeding lines 21A and 21B, respectively. Each of the feeding lines 22A and 22B is a coaxial cable having a diameter of about 1 mm.

The radio communication antenna 12A is disposed in a top left portion of the displaying portion 10. On the other hand, the radio communication antenna 12B is disposed in a lower right-hand portion of the displaying portion 10. Such disposition makes a distance between mutual installation positions of the radio communication antennas 12A and 12B large as compared with the case of disposition in which both the radio communication antennas 12A and 12B are arranged in an upper portion of the displaying portion 10. In addition, the radio communication antenna 12B is installed at an angle of 90° with respect to the radio communication antenna 12A.

Construction of Radio Communication Antenna

FIG. 1B is a plan view showing the radio communication antenna 12A. Since the radio communication antennas 12A and 12B have the same construction in the first embodiment, only the radio communication antenna 12A will now be described. In addition, for the sake of making the description easy, illustration is made such that an insulating protective layer 125 for protecting an antenna conductor is partially removed.

The radio communication antenna 12A has a folded monopole antenna 120 as a first antenna element, a monopole antenna 121 as a second antenna element, and a GND pattern 122 connected to the folded monopole antenna 120. A surface of the radio communication antenna 12A is covered with the insulating protective layer 125.

A start end of the radio communication antenna 12A is connected to a feeder line (not shown) at a feeding point 120A. In addition, a finish end of the radio communication antenna 12A is connected to the GND pattern 122 at a grounding point 120B. A distance (interval) between the feeding point 120A and the grounding point 120B is set equal to or shorter than a fifth of a wavelength of a resonance frequency of the folded monopole antenna 120. At that, an upper limit, i.e., the fifth of the wavelength is an empirical value with which an effect of the folded monopole antenna is exhibited.

A length from the feeding point 120A of the folded monopole antenna 120 to the grounding point 120B through a stub 123 is set to a value corresponding to a half of a wavelength of a frequency belonging to a frequency band used in radio communication (hereinafter referred to as "a use frequency band"). The frequency concerned is the resonance frequency of the folded monopole antenna 120. A path from the feeding point 120A of the folded monopole antenna 120 to the stub 123 is an outward path, and a path from the stub 123 to the grounding point 120B is a return path.

The stub 123 short-circuits the outward path and return path of the folded monopole antenna 120, and is different in formation width from each of the outward path and return path of the folded monopole antenna 120. More specifically, the stub 123 constitutes a frequency adjusting portion which is formed in face shape by burying an area formed by the outward path and the return path.

The monopole antenna 121 branches, from the folded monopole antenna 120, at a branch point 124 which located between the feeding point 120A in the outward path of the folded monopole antenna 120 and the stub 123. A head of the monopole antenna 121 is released. The folded monopole antenna 120 and the monopole antenna 121 share a part, of the outward path, from the feeding point 120A to the branch point 124.

A length from the feeding point 120A to the head of the monopole antenna 121 through the branch point 124 is set to a value corresponding to a quarter of a wavelength of a frequency belonging to the use frequency band of the radio communication. The frequency concerned is a resonance frequency of the monopole antenna 121. The resonance frequency of the monopole antenna 121 is selected as a value different from the resonance frequency of the folded monopole antenna 120, thereby obtaining the multi-resonance type radio communication antenna 12A.

In the first embodiment, each of the folded monopole antenna 120, the monopole antenna 121 and the GND pattern 122 is made of a copper alloy having a thickness of 0.1 to 0.2 mm. At that, the conductor pattern may be made of any other suitable conductive material such as aluminum other than the copper alloy. In addition, the insulating protective layer 125 covering the conductor portion is formed by sticking polyimide films each having a thickness of 0.5 mm to both sides of the conductor portion, respectively. The feeding point 120A and an opening portion 125A for electrical connection to the ground are provided in the polyimide film, on this side of the paper, in FIG. 1B. At that, the insulating protective layer 125 may also be made of an insulating material such as a fluorine contained resin film other than the polyimide film.

In the radio communication antenna 12A of the first embodiment, the stub 123 provided in the folded portion of the folded monopole antenna 120 has a large area. Thus, since the folded monopole antenna 120 has a larger head capacity than that when it is made of a loop-like conductor, the resonance frequency is shifted to the lower frequencies.

Figure 2:
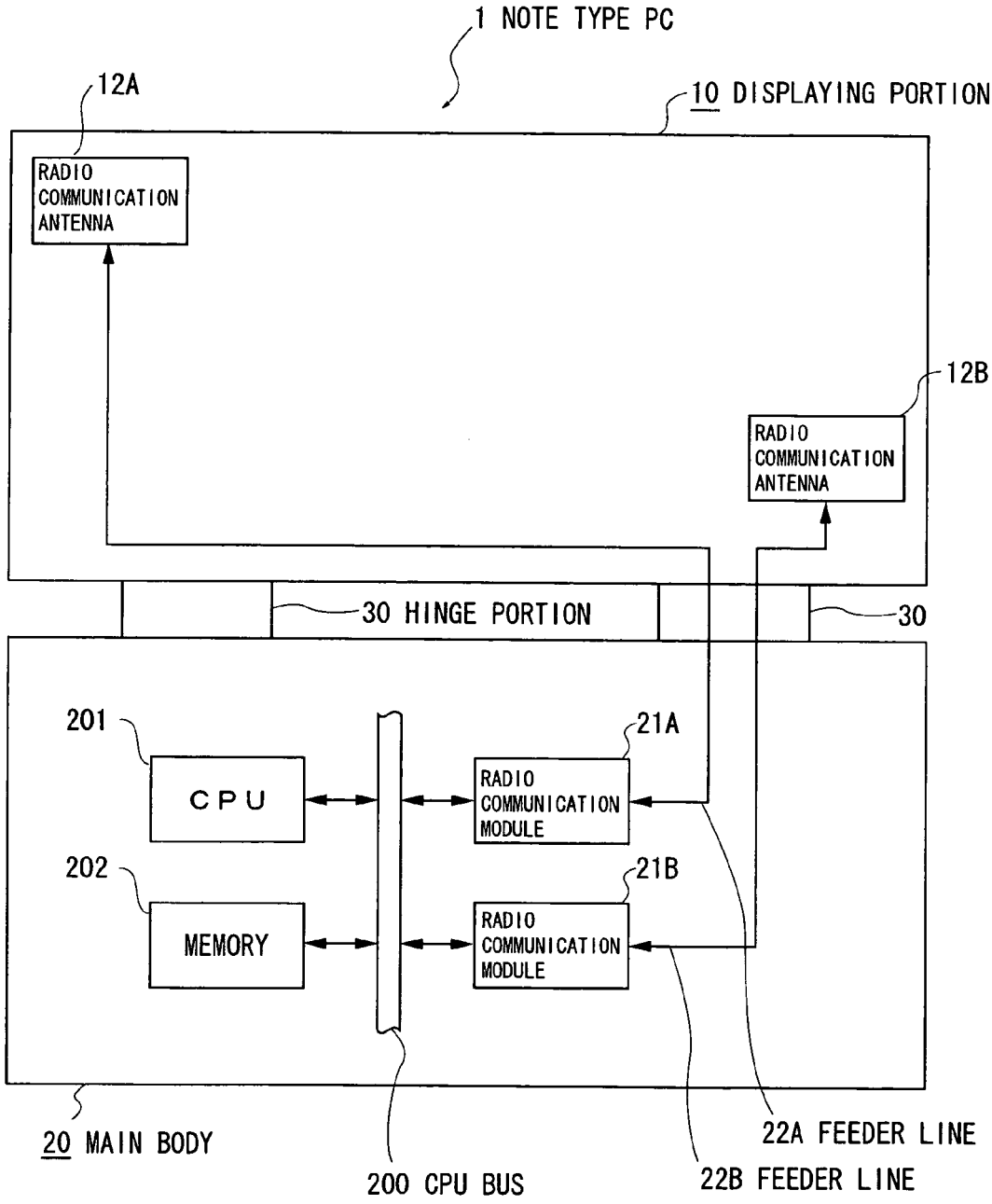
FIG. 2 is an exemplary block diagram showing a configuration of the note type personal computer according to the first embodiment of the present invention.

FIG. 2 is a block diagram showing a configuration of the note type PC according to the first embodiment of the present invention. The radio communication modules 21A and 21B are connected to a CPU 201 and a memory 202 through a CPU bus 200. Each of the radio communication modules 21A and 21B includes a radio frequency (RF) portion, a quartz oscillating portion, and a base band processing portion (which are not shown).

According to the first embodiment described above, provision of the stub 123 serving as the frequency matching portion as well and having the large area in the folded monopole antenna 120 results in that the conductor area can be made large, and the resonance frequency can be shifted to the lower frequencies. In addition, since the resonance frequency can be adjusted by cutting the stub 123, the frequency of the radio communication antenna can be readily adjusted.

In addition, as shown in FIG. 1A, the distance between the installation positions of the radio communication antennas 12A and 12B is made large, whereby the space diversity effect can be enhanced, and the wave radiation efficiency can be improved.

Moreover, the radio communication antenna 12B is installed at the angle of 90° with respect to the radio communication antenna 12A in order to receive different polarized waves, whereby the pattern diversity effect can be enhanced and the wave radiation efficiency can be improved.

Second Embodiment

Figure 3:
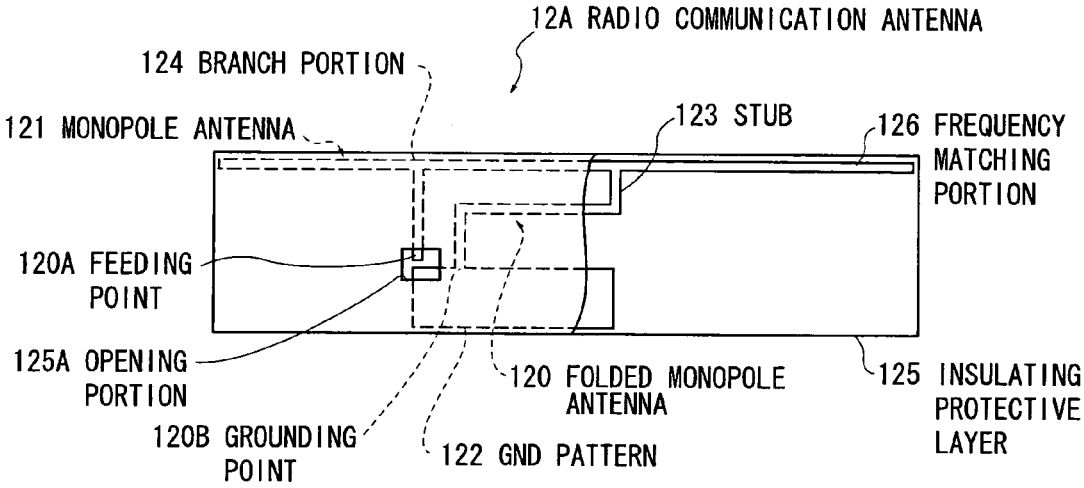
FIG. 3 is an exemplary plan view showing a radio communication antenna according to a second embodiment of the present invention.

FIG. 3 is a plan view showing a radio communication antenna according to a second embodiment of the present invention. At that, in the following description, the portions having the same constructions and functions as those of the first embodiment are designated with the same reference numerals, respectively.

The radio communication antenna 12A has a construction in which the frequency matching portion 126 described in the first embodiment is provided as an extension from the outward path of the folded monopole antenna 120. With this construction, the outward path of the folded monopole antenna 120 and the frequency matching portion 126 have the same width and are disposed in one straight line.

According to the second embodiment described above, provision of the frequency matching portion equal in straight line to the outward path portion in the folded monopole antenna 120 results in that even when there is a disposition restriction in the mounting region of the antenna, the multi-resonance type radio communication antenna 12A is obtained which is excellent in the wave reception efficiency. In addition, since the frequency matching portion 126 is formed with a slender width than that of the frequency matching portion 123 in the first embodiment, the frequency matching can be finely adjusted by cutting the frequency matching portion 126.

In addition, since the interval (distance) between the slender frequency matching portion 126 and the GND pattern 122 can be made large, a change in degree of frequency matching can be suppressed, and the radiation efficiency can be improved.

It should be noted that while in the second embodiment, the description has been given with respect to the construction in which the outward path of the folded monopole antenna 120 and the frequency matching portion 126 are formed with the same width, they may also be formed with different widths, respectively.

Third Embodiment

Figure 4A:
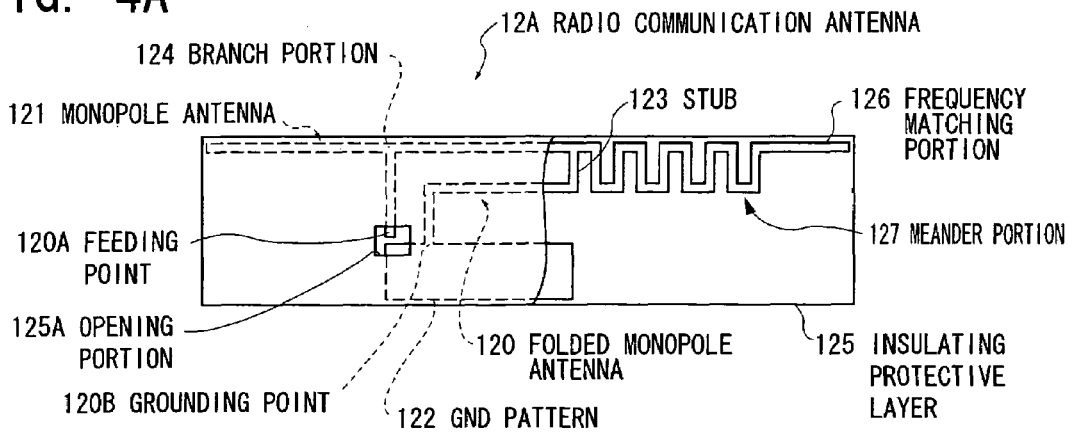
FIGS. 4A, 4B and 4C are respectively an exemplary plan view showing a radio communication antenna according to a third embodiment of the present invention, an exemplary plan view showing a construction in which a meander portion shown in FIG. 4A is provided on a stub side, and an exemplary plan view showing a construction in which the meander portion shown in FIG. 4A is provided on a head side of a frequency matching portion.
Figure 4B:
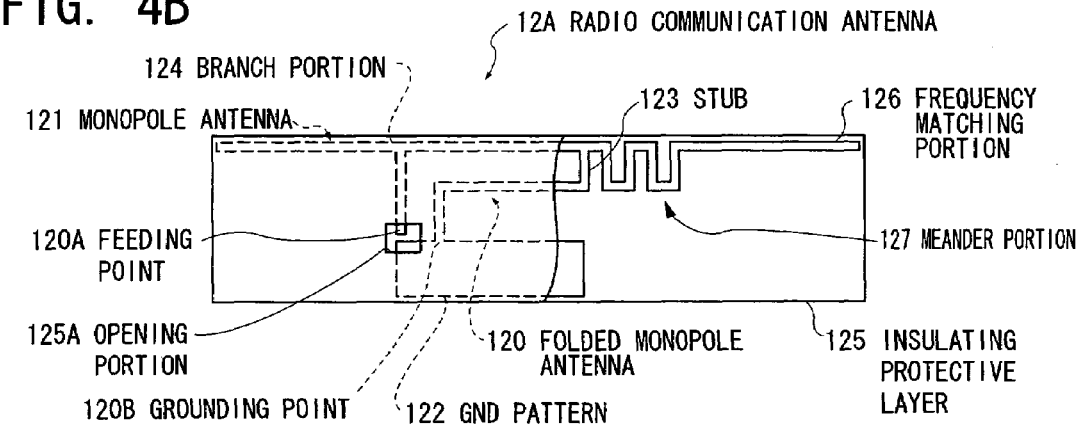
Figure 4C:
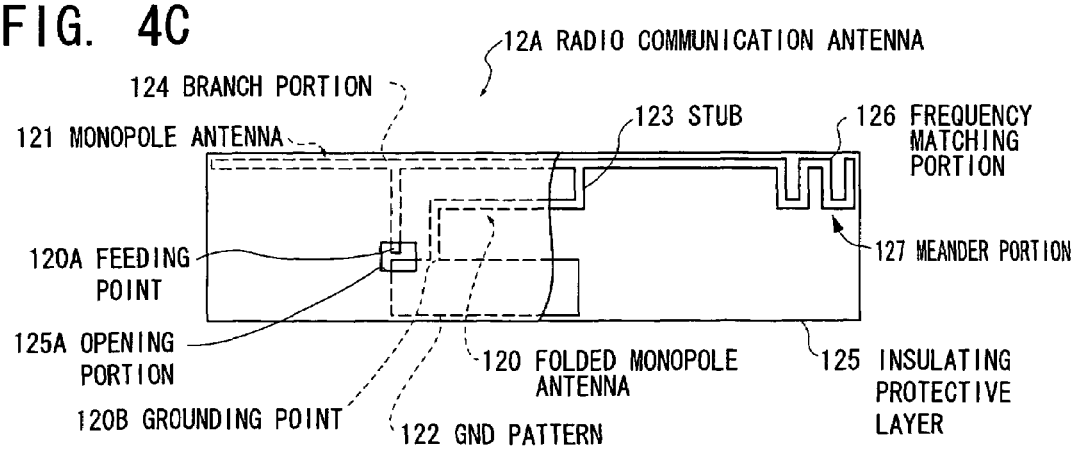

FIGS. 4A, 4B and 4C are respectively a plan view showing a radio communication antenna according to a third embodiment of the present invention, a plan view showing a construction in which a meander portion shown in FIG. 4A is provided on a stub side, and a plan view showing a construction in which the meander portion shown in FIG. 4A is provided on a head side of a frequency matching portion.

The radio communication antenna 12A has a construction in which a portion 127 folded in meander-like shape (hereinafter referred to as "a meander portion 127") is added to the frequency matching portion 126 described in the second embodiment. With this construction, the outward path of the folded monopole antenna 120 and the frequency matching portion 126 are formed with the same width. Alternatively, the meander portion 127 can be provided on a side near the stub 123 as shown in FIG. 4B, or can be provided on a side away from the stub 123 as shown in FIG. 4C.

According to the third embodiment described above, provision of the meander portion 127 in the frequency matching portion 126 results in that the conductor length of the frequency matching portion 126 can be lengthened, and the resonance frequency can be shifted to the lower frequencies. In addition, with the construction in which the meander portion 127 is provided near the stub 123 as shown in FIG. 4B, the resonance frequency can be readily adjusted by cutting the head of the frequency matching portion 126.

Fourth Embodiment

Figure 5A:
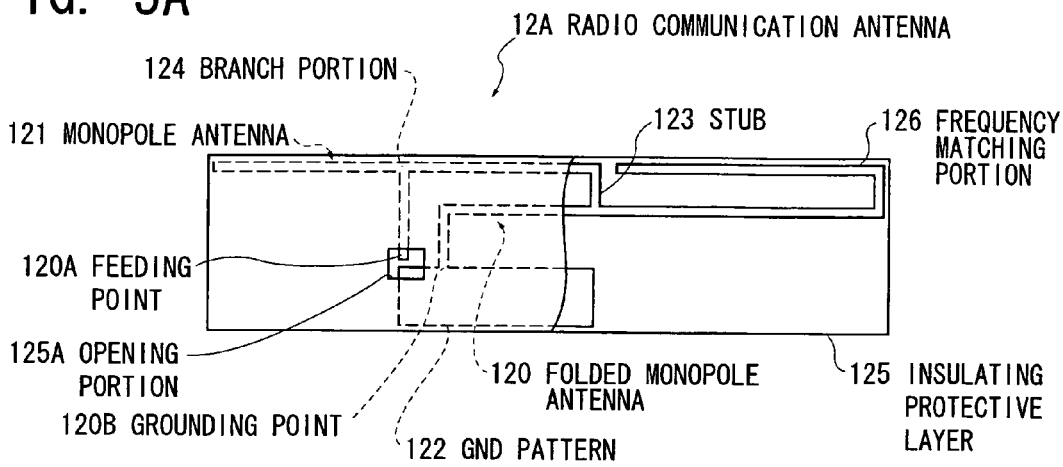
FIGS. 5A, 5B and 5C are respectively an exemplary plan view showing a radio communication antenna according to a fourth embodiment of the present invention, an exemplary plan view showing a construction in which a start point and a folding direction of a frequency matching portion are different from those of a frequency matching portion shown in FIG. 5A, and an exemplary plan view showing a construction in which the meander portion is added to the frequency matching portion shown in FIG. 5A.
Figure 5B:
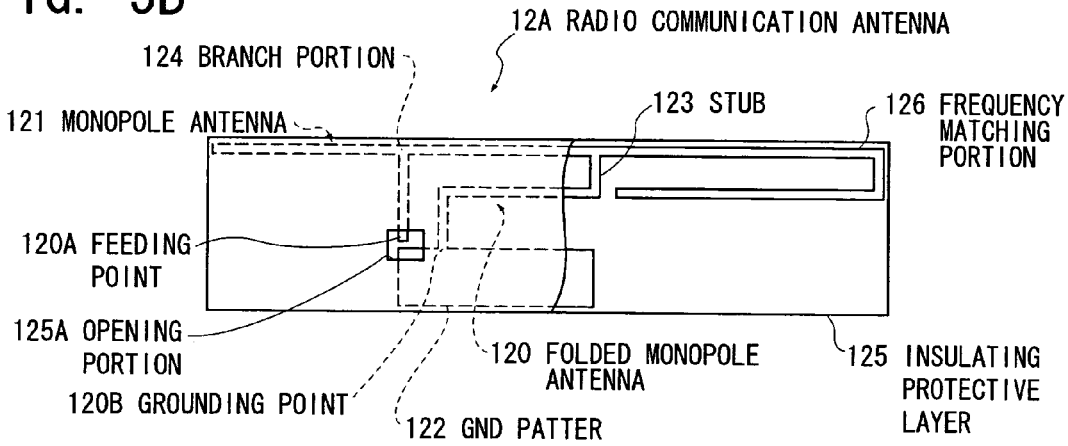
Figure 5C:
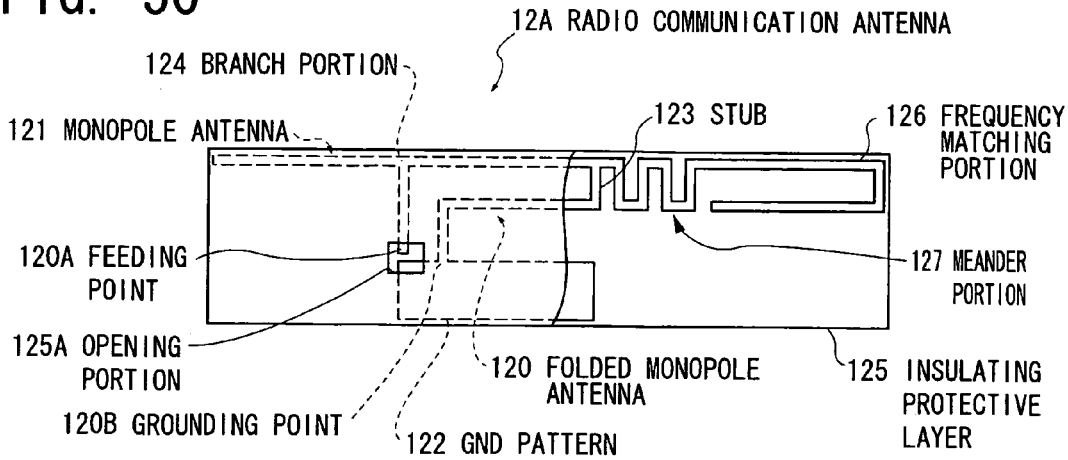

FIGS. 5A, 5B and 5C are respectively a plan view showing a radio communication antenna according to a fourth embodiment of the present invention, a plan view showing a construction in which the start point and a folding direction of the frequency matching portion are different from those of the frequency matching portion shown in FIG. 5A, and a plan view showing a construction in which the meander portion is added to the frequency matching portion shown in FIG. 5A.

The radio communication antenna 12A has a construction in which the frequency matching portion 126 described in the second embodiment is extended to be folded in squared U-shape. In this case, the frequency matching portion 126 can be provided on the return path side of the stub 123 as shown in FIG. 5A, or can be provided on the outward path side of the stub 123 as shown in FIG. 5B. In addition to these constructions, a construction can be adopted such that the meander portion 127 is added to the frequency matching portion 126 as shown in FIG. 5C.

According to the fourth embodiment described above, in addition to the effects of the third embodiment, an effect is offered in which the conductor length of the frequency matching portion 126 can be further lengthened without increasing the size of the radio communication antenna 12A. In addition, addition of the meander portion 127 to the frequency matching portion 126 makes it possible to shift the resonance frequency to the lower frequencies.

Fifth Embodiment

Figure 6A:
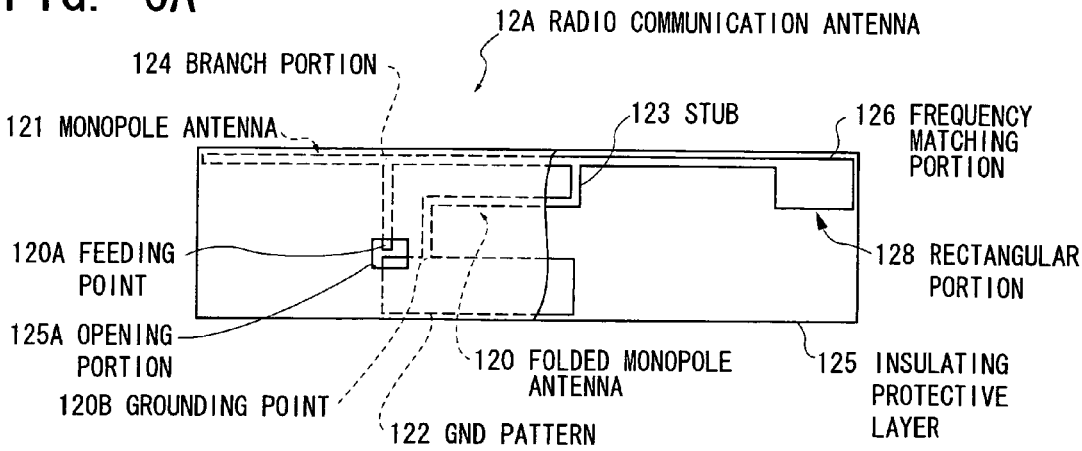
FIGS. 6A, 6B and 6C are respectively an exemplary plan view showing a radio communication antenna according to a fifth embodiment of the present invention, an exemplary plan view showing a construction in which a rectangular portion shown in FIG. 6A is disposed at a center of the frequency matching portion, and an exemplary plan view showing a construction in which the rectangular portion shown in FIG. 6A is disposed on a stub side.
Figure 6B:
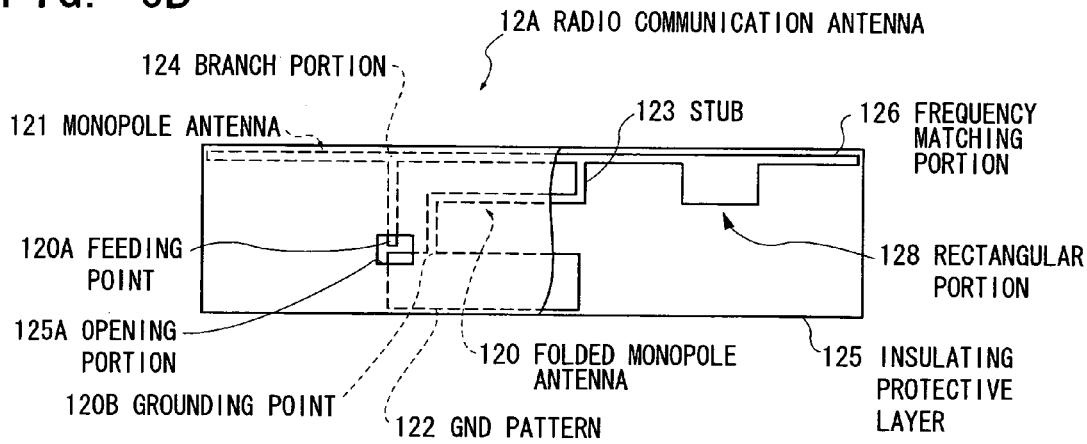
Figure 6C:
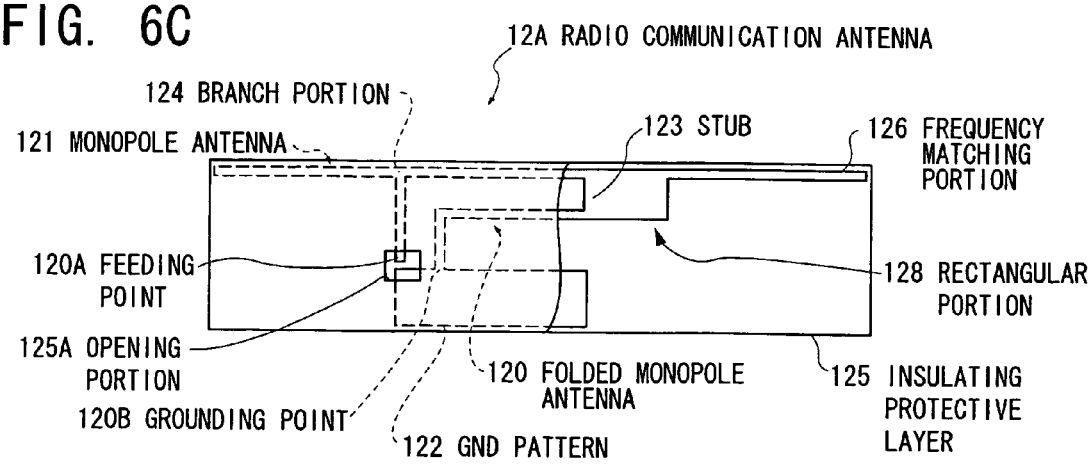

FIGS. 6A, 6B and 6C are respectively a plan view showing a radio communication antenna according to a fifth embodiment of the present invention, a plan view showing a construction in which a rectangular portion shown in FIG. 6A is disposed at a center of the frequency matching portion, and a plan view showing a construction in which the rectangular portion shown in FIG. 6A is disposed on a stub side.

In the radio communication antenna 12A, a rectangular portion 128 which is different in size from the conductor of the folded monopole antenna 120 portion is provided in the frequency matching portion 126 described in the second embodiment. The rectangular portion 128 can be provided in the head of the frequency matching portion 126 as shown in FIG. 6A, or can be provided in an arbitrary position between the head of the frequency matching portion 126 and the stub 123 as shown in FIG. 5B. Or, the rectangular portion 128 can be provided on the stub 123 side of the frequency matching portion 126 as shown in FIG. 6C.

According to the fifth embodiment described above, provision of the rectangular portion 128 in the frequency matching portion 126 results in that the resonance frequency can be shifted to the lower frequencies, and the resonance frequency can be readily adjusted by cutting the frequency matching portion 126.

Sixth Embodiment

Figure 7:
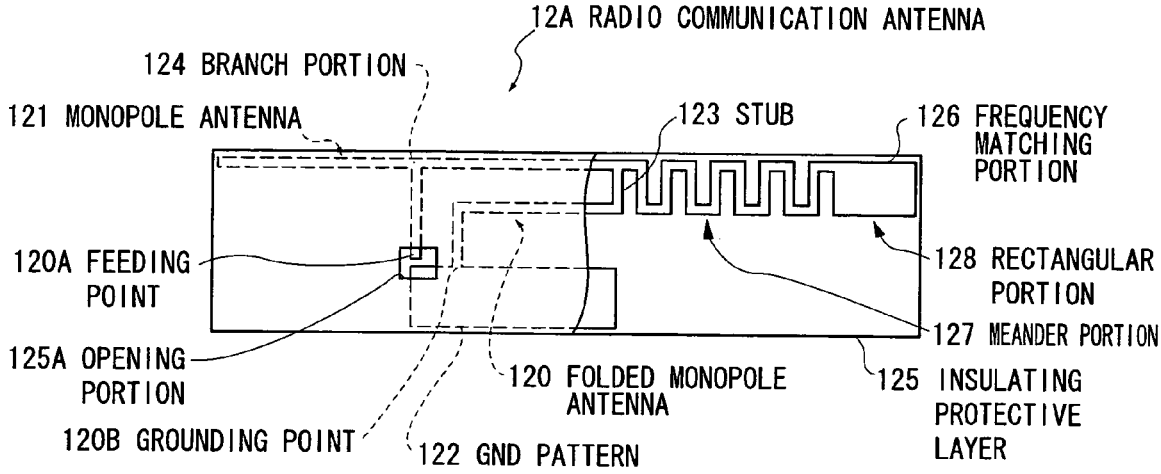
FIG. 7 is an exemplary plan view showing a radio communication antenna according to a sixth embodiment of the present invention.

FIG. 7 is a plan view showing a radio communication antenna according to a sixth embodiment of the present invention.

The radio communication antenna 12A is constructed such that the meander portion 127 is added to the frequency matching portion 126 described in the fifth embodiment and the rectangular portion 128 shown in FIG. 6A is provided in the head of the meander portion 127 provided on the stub 123 side.

According to the sixth embodiment described above, in addition to the effects of the fifth embodiment, an effect is offered in which adjustment of the size of the meander portion 127 makes it possible to miniaturize the radio communication antenna 12A.

Seventh Embodiment

Figure 8:
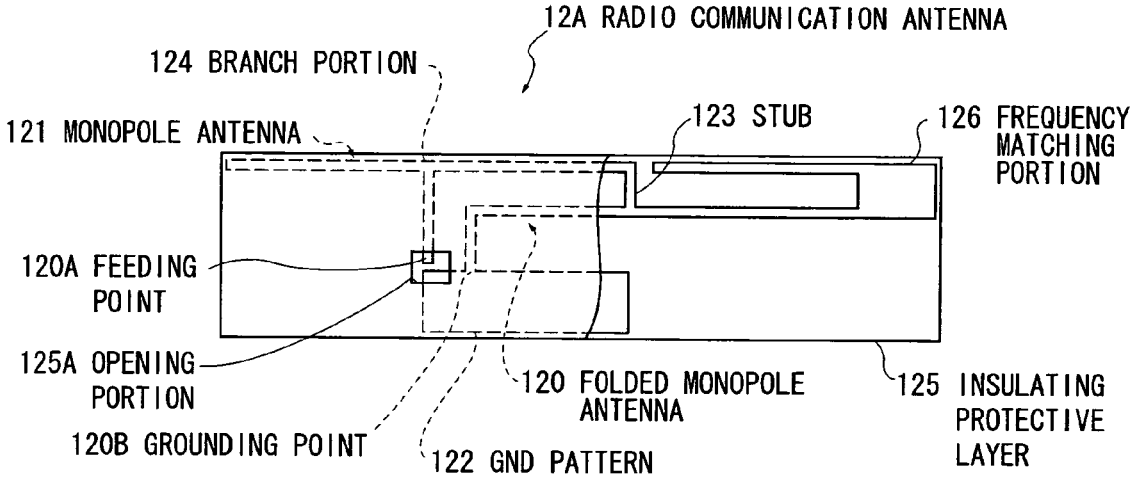
FIG. 8 is an exemplary plan view showing a radio communication antenna according to a seventh embodiment of the present invention.

FIG. 8 is a plan view showing a radio communication antenna according to a seventh embodiment of the present invention.

The radio communication antenna 12A is constructed such that the conductor area in the squared U-shape folded portion of the frequency matching portion 126 described in the fourth embodiment is made large.

According to the seventh embodiment described above, in addition to the effects of the fourth embodiment, an effect is offered in which the resonance frequency can be largely shifted to the lower frequencies due to provision of the rectangular portion 128 described in the fifth embodiment, and the radio communication antenna 12A can be miniaturized.

Eighth Embodiment

Figure 9A:
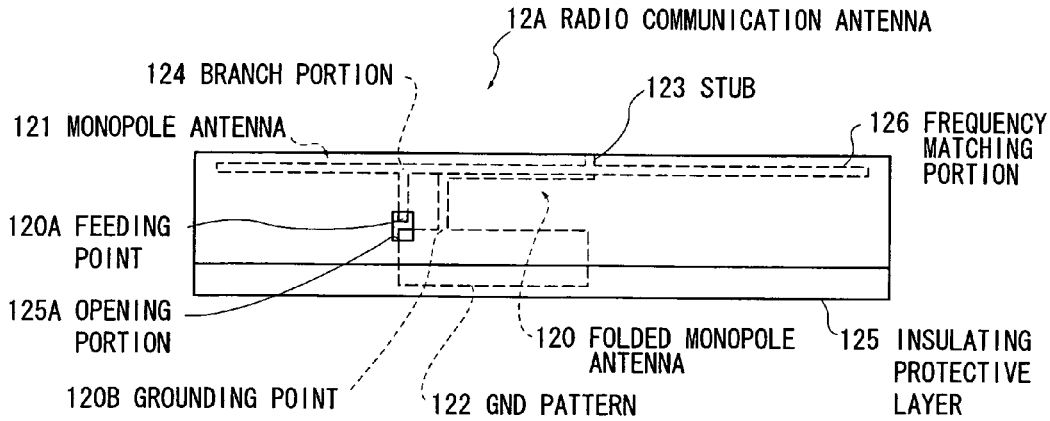
FIGS. 9A and 9B are respectively an exemplary plan view showing a radio communication antenna according to an eighth embodiment of the present invention, and a plan view before an insulating protective layer is folded in the eighth embodiment of the present invention.
Figure 9B:
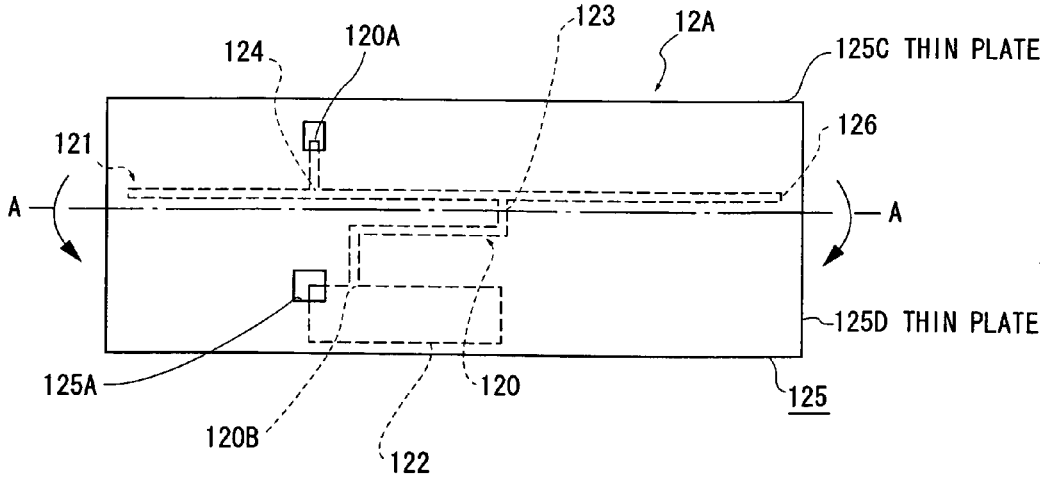

FIGS. 9A and 9B are respectively a plan view showing a radio communication antenna according to an eighth embodiment of the present invention, and a plan view before the insulating protective layer is folded in the eighth embodiment of the present invention.

In the radio communication antenna 12A, the conductor pattern of the radio communication antenna 12A is formed in lamination form so as to straddle thin plates 125C and 125D of the insulating protective layer 125. Also, the thin plate 125C is bent on the thin plate 125D about a portion to be bent indicated by a line A-A so as to fold the stub 123, whereby an apparent folded size of the folded monopole antenna 120 is reduced.

According to the eighth embodiment described above, the insulating protective layer 125 including the conductor which is planarly formed is bent without finely forming a conductor pattern to be laminated on the insulating protective layer 125, whereby the multi-layered structure of the radio communication antenna 12A can be readily realized, and miniaturization and cost down of the radio communication antenna 12A can be realized. In addition, keeping the position to be bent from the GND pattern 122 results in that the radiation efficiency can be improved and the broadening of the band can be adjusted. It should be noted that while in this embodiment, the description has been given with respect to the construction in which the conductor pattern having the polyimide film laminated thereon is bent, a construction may be adopted in which the portion to be bent is constituted by a flexible substrate, and one portion on which the other portion is to be folded is constituted by a substrate made of metal, glass epoxy or the like.

Ninth Embodiment

Figure 10A:
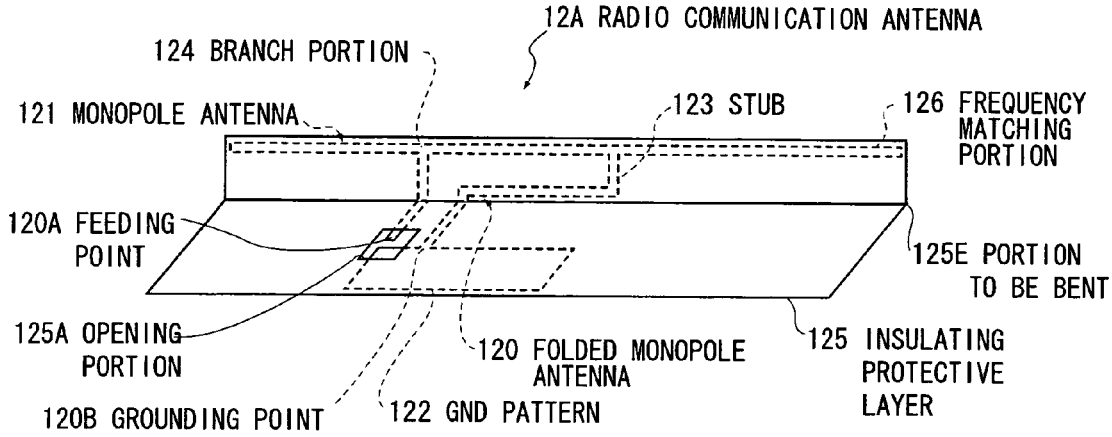
FIGS. 10A and 10B are respectively an exemplary perspective view showing a radio communication antenna according to a ninth embodiment of the present invention, and an exemplary perspective view showing a mounting example of the radio communication antenna shown in FIG. 10A.
Figure 10B:
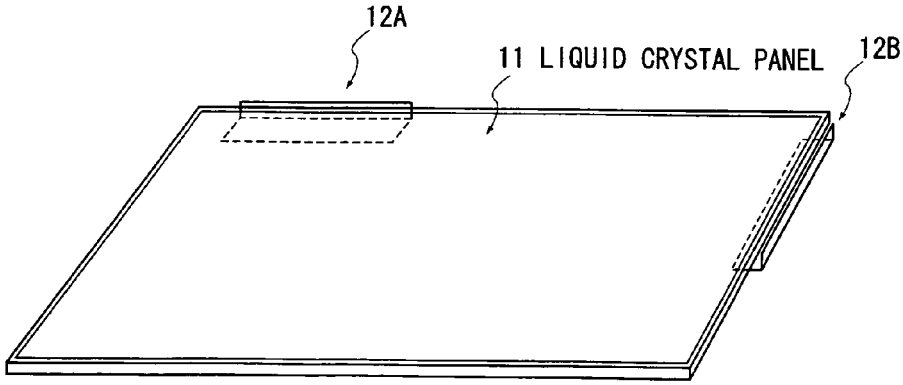

FIGS. 10A and 10B are respectively a perspective view showing a radio communication antenna according to a ninth embodiment of the present invention, and a perspective view showing a mounting example of the radio communication antenna shown in FIG. 10A.

The radio communication antenna 12A, as shown in FIG. 10A, is formed in L letter-like shape by bending the radio communication antenna 12A described in the second embodiment at an angle of 90° in a portion 125E to be bent. Thus, the radio communication antenna 12A is formed so that the side to be bent including the branch portion 124 includes a part of the outward path of the folded monopole antenna 120, the stub 123, and a part of the return path of the folded monopole antenna 120.

FIG. 10B shows a mounting example of the radio communication antenna 12A shown in FIG. 10A. The radio communication antenna 12A which is bent in L letter-like shape as shown in FIG. 10A can be installed in a liquid crystal panel 11 along a side face and a bottom face of the liquid crystal panel 11. Hence, the accommodating property of a displaying portion chassis (not shown) is improved.

According to the ninth embodiment described above, the insulating protective layer 125 is bent in L letter-like shape at the angle of 90° in the portion 125E to be bent. Hence, when the antenna is mounted inside an electronic apparatus, the antenna can be mounted even in a narrow place or the like along a corner portion of an end of the chassis or the like. Thus, a long distance from a peripheral metallic construction or the like is obtained, and the radiation efficiency is improved. While in this embodiment, the construction has been described in which the insulating protective layer 125 is bent at the angle of 90° in the portion 125E to be bent, the bend angle may be any other suitable one other than the angle of 90°.

Tenth Embodiment

Figure 11A:
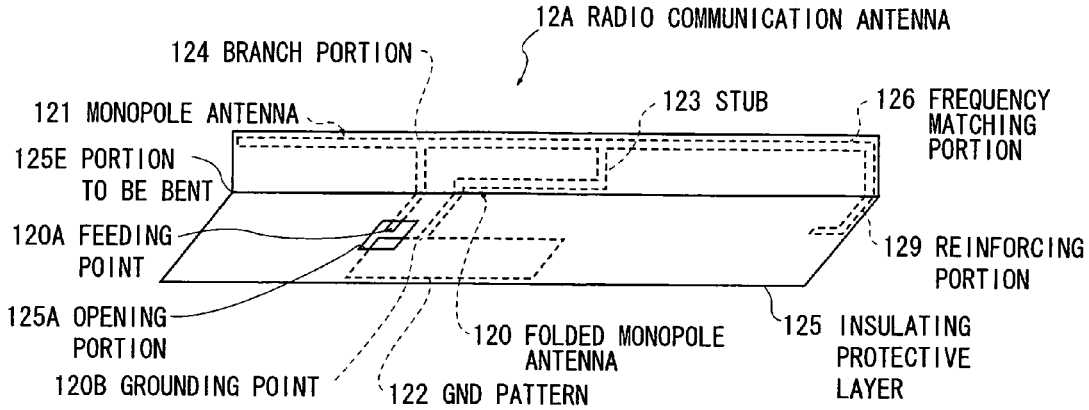
FIGS. 11A, 11B and 11C are respectively an exemplary perspective view showing a bend reinforcing portion provided on one side in a radio communication antenna according to a tenth embodiment of the present invention, an exemplary perspective view showing a bend reinforcing portion provided on the other side in the radio communication antenna according to the tenth embodiment of the present invention, and an exemplary perspective view showing bend reinforcing portions provided on both the sides, respectively, in the radio communication antenna according to the tenth embodiment of the present invention.
Figure 11B:
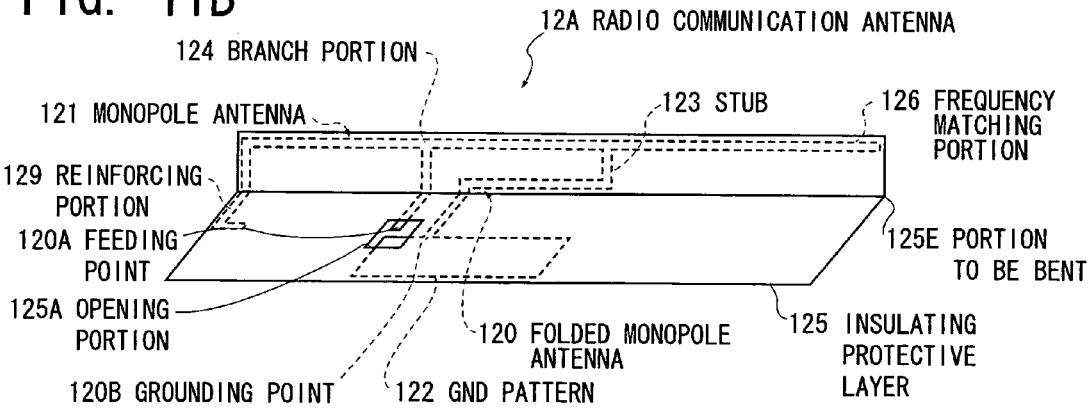
Figure 11C:
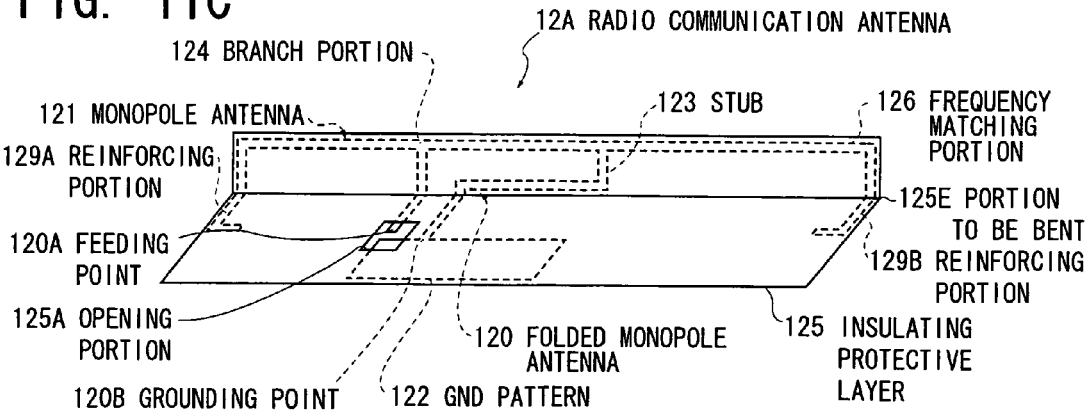

FIGS. 11A, 11B and 11C are respectively a perspective view showing a bend reinforcing portion provided on one side in a radio communication antenna according to a tenth embodiment of the present invention, a perspective view showing a bend reinforcing portion provided on the other side in the radio communication antenna according to the tenth embodiment of the present invention, and a perspective view showing bend reinforcing portions provided on both the sides, respectively, in the radio communication antenna according to the tenth embodiment of the present invention.

The radio communication antenna 12A is constructed such that there are provided reinforcing portions 129, 129A and 129B for reinforcing the bent shape of the radio communication antenna 12A described in the ninth embodiment. Thus, the bent shape is prevented from being impaired by a restoring property of the insulating protective layer 125 made of the polyimide film. In this case, a construction is adopted in which the reinforcing portion 129 is formed as an extension from the frequency matching portion 126 so as to straddle the portion 125E to be bent as shown in FIG. 11A. In addition to the construction shown in FIG. 11A, a construction may also be adopted in which the reinforcing portion 129A is provided as an extension from the head of the monopole antenna 120 as shown in FIG. 11B. Moreover, when the insulating protective layer 125 has a large thickness, or the insulating protective layer 125 is made of a different material having the large restoring property, preferably, as shown in FIG. 11C, the reinforcing portion 129A is provided on the head side of the monopole antenna 121 so as to straddle the portion 125E to be bent, and the reinforcing portion 129B is provided in the head of the frequency matching portion 126 so as to straddle the portion 125E to be bent.

According to the tenth embodiment described above, in addition to the effects of the ninth embodiment, an effect is offered in which the restoring property of the insulating protective layer 125 can be suppressed, and the radiation property can be prevented from being reduced due to such a cause that the radio communication antenna 12A comes into contact with other metallic portions or the like when the chassis is accommodated.

Eleventh Embodiment

Figure 12:
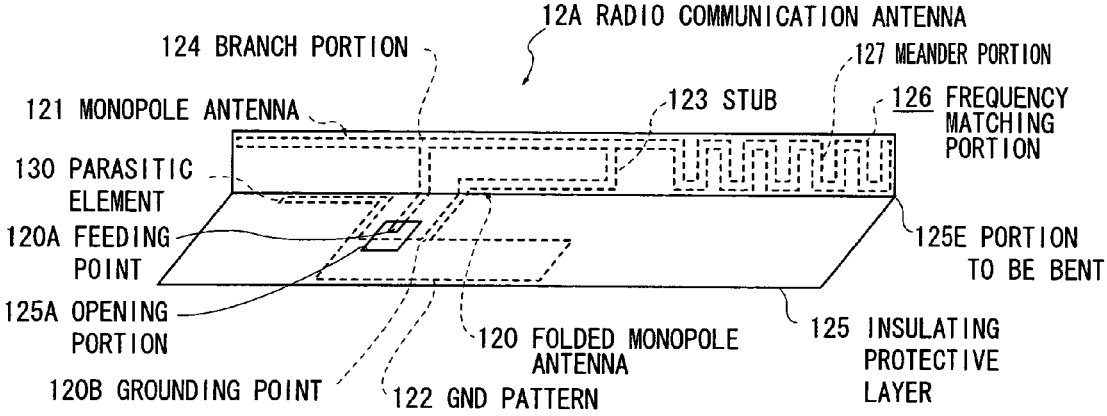
FIG. 12 is an exemplary perspective view showing a radio communication antenna according to an eleventh embodiment of the present invention.

FIG. 12 is a perspective view of a radio communication antenna according to an eleventh embodiment of the present invention.

The radio communication antenna 12A is constructed such that the meander portion 127 is added to the frequency matching portion 126 of the radio communication antenna 12A described in the ninth embodiment, and a parasitic element 130 connected to the GND pattern 122 is provided on the GND pattern 122 formation side.

According to the eleventh embodiment described above, in addition to the effects of the ninth embodiment, an effect is offered in which the shifting property of the resonance frequency to the lower frequencies can be enhanced. In addition, provision of the parasitic element 130 makes it possible to broaden the band of the high frequencies. As a result, the compact multi-resonance type radio communication antenna 12A is obtained which has the characteristics of the broad band from 800 MHz to 2.2 GHz and which has the satisfactory resonance characteristics. At that, the restoring property of the insulating protective layer 125 may be reduced by providing the reinforcing portion described in the tenth embodiment.

It should be noted that the present invention is not limited to the first to eleventh embodiments described above, and the various combinations and changes may be made without departing from or changing the technical idea of the present invention.

What is claimed is:

1. A radio device, comprising:

a power supply circuit for generating a high-frequency signal corresponding to a transmission signal to be transmitted in a radio manner;

a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion; and a second antenna branching, from the first antenna, in a branch portion located between the feeding point in the outward path and the short-circuit portion, having an open end and having a portion from the feeding point in the outward path to the branch portion in common with the first antenna, a length from the feeding point to the open end through the branch portion corresponding to a quarter of a wavelength of the second frequency belonging to the use frequency band, wherein the folded path of the first antenna has a length corresponding to a half of the wavelength of the second frequency, or a value close thereto.

2. A radio device according to claim 1, wherein:
the frequency matching portion is made of a conductor having a formation width different from that of each of the outward path and the return path.

3. A radio device according to claim 1, wherein:
the frequency matching portion has an extension portion which branches at one point in the outward path to extend in a formation direction of the outward path.

4. A radio device according to claim 1, wherein:
the frequency matching portion has an extension portion which branches at one point in the outward path to extend in a formation direction of the outward path, and has a portion which is folded in meander-like shape in the extension portion.

5. A radio device according to claim 1, wherein:
the frequency matching portion has an extension portion which branches at one point in the outward path to extend in a direction of the outward path, and which is folded in squared U-shape.

6. A radio device according to claim 1, wherein:
the frequency matching portion has a portion which branches at one point in the outward path to extend in a formation direction of the outward path and is folded in meander-like shape, and has an extension portion which is folded in squared U-shape.

7. A radio device according to claim 1, wherein:
the frequency matching portion has an extension portion which branches at one point in the outward path to extend in a formation direction of the outward path, and which includes a portion different in formation width from each of the outward path and the return path.

8. A radio device according to claim 1, wherein:
the frequency matching portion has an extension portion which branches at one point in the outward path to extend in a formation direction of the outward path, and the extension portion includes a portion which is folded in meander-like shape, and a portion which is different in formation width from each of the outward path and the return path.

9. A radio device according to claim 1, wherein:
the frequency matching portion has an extension portion which branches at one point in the return path to extend in a direction opposite to that of the return path, and which is folded in squared U-shape.

10. A radio device according to claim 1, wherein:
a sheet-like first area including a conductor having the feeding point and the branch point formed therein is bent in the short-circuit portion on a sheet-like second area including a conductor having the grounding point formed therein, thereby making the feeding point and the grounding point close to each other in the first and second antennas.

11. A radio device, comprising:
a power supply circuit for generating a high-frequency signal corresponding to a transmission signal to be transmitted in a radio manner;
a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion;
a second antenna branching, from the first antenna, in a branch portion located between the feeding point in the outward path and the short-circuit portion, having an open end and having a portion from the feeding point in the outward path to the branch portion in common with the first antenna, a length from the feeding point to the open end through the branch portion corresponding to a quarter of a wavelength of the second frequency belonging to the use frequency band; and
a parasitic element connected to the grounding point,
wherein the folded path of the first antenna has a length corresponding to a half of the wavelength of the second frequency, or a value close thereto.

12. An electronic apparatus, comprising:
a radio communication portion; and
an enclosure case for accommodating therein the radio communication portion,
the radio communication portion, comprising:
a power supply circuit for generating a high-frequency signal corresponding to a transmission signal to be transmitted in a radio manner;
a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion; and
a second antenna branching, from the first antenna, in a branch portion located between the feeding point in the outward path and the short-circuit portion, having an open end and having a portion from the feeding point in the outward path to the branch portion in common with the first antenna, a length from the feeding point to the open end through the branch portion corresponding to a quarter of a wavelength of the second frequency belonging to the use frequency band,
wherein the folded path of the first antenna has a length corresponding to a half of the wavelength of the second frequency, or a value close thereto.

13. An electronic apparatus, comprising:
a radio communication portion; and
an enclosure case for accommodating therein the radio communication portion,
the radio communication portion, comprising:
a power supply circuit for generating a high-frequency signal corresponding to a transmission signal to be transmitted in a radio manner;
a first antenna including a folded path having a start end connected to the power supply circuit at a feeding point and a frequency matching portion connected to the folded path for matching first and second frequencies each other, a length between the start end and a finish end corresponding to a half of a wavelength of the first frequency belonging to a use frequency band, the folded path being folded so that the finish end is grounded to a grounding point located at a distance equal to or shorter than a fifth of the wavelength of the first frequency from the feeding point, thereby having an outward path and a return path, one point in the outward path and one point in the return path being short-circuited at a short-circuit portion so that the folded path reaches the grounding point through the feeding point and the short-circuit portion;

a second antenna branching, from the first antenna, in a branch portion located between the feeding point in the outward path and the short-circuit portion, having an open end and having a portion from the feeding point of the outward path and the branch portion in common with the first antenna, a length from the feeding point to the open end through the branch portion corresponding to a quarter of a wavelength of the second frequency belonging to the use frequency band; and a parasitic element connected to the grounding point, wherein the folded path of the first antenna has a length corresponding to a half of the wavelength of the second frequency, or a value close thereto.

* * * * *